US005345916A

United States Patent [19]

Amann et al.

[11] Patent Number: 5,345,916

[45] Date of Patent: Sep. 13, 1994

[54] CONTROLLED FUEL INJECTION RATE FOR OPTIMIZING DIESEL ENGINE OPERATION

[75] Inventors: Richard W. Amann, Bloomfield Hills; Sharon W. Lum, Farmington, both of Mich.

[73] Assignee: General Motors Corporation, Detroit, Mich.

[21] Appl. No.: 22,204

[22] Filed: Feb. 25, 1993

[51] Int. Cl.[5] ..... F02M 37/04

[52] U.S. Cl. ..... 123/506; 123/496; 123/500; 123/450

[58] Field of Search ..... 123/506, 458, 450, 496, 123/500, 501

[56] References Cited

U.S. PATENT DOCUMENTS

| | | | |
|---|---|---|---|
| 4,377,139 | 3/1983 | Jarrett | 123/450 |
| 4,395,987 | 8/1983 | Kobayashi | 123/506 |
| 4,446,836 | 5/1984 | Mowbray et al. | 123/450 |
| 4,586,480 | 5/1986 | Kobayashi | 123/506 |
| 4,757,795 | 7/1988 | Kelly | 123/506 |
| 4,777,921 | 10/1988 | Miyaki | 123/506 |
| 4,884,549 | 12/1989 | Kelly | 123/506 |
| 5,094,216 | 3/1992 | Miyaki | 123/506 |
| 5,103,792 | 4/1992 | Winkler | 123/506 |
| 5,197,438 | 3/1993 | Yamamoto | 123/506 |
| 5,201,297 | 4/1993 | Eblen | 123/506 |
| 5,205,262 | 4/1993 | Anton | 123/506 |
| 5,228,844 | 7/1993 | Klopper | 123/506 |

*Primary Examiner*—Carl S. Miller

*Attorney, Agent, or Firm*—Karl F. Barr, Jr.

[57] ABSTRACT

Fuel delivery system for internal combustion engines and method of delivering fuel by the automatic selection and use of different sections of the fuel pumping ramp of a cam mechanism within the system to control the rate of fuel injection by varying and shaping injection pressure waves or pulses to match engine air intake flow for different engine speed and load conditions. A solenoid operated fuel delivery valve is employed for controlling fuel timing and quantity by commands from a microprocessor with inputs which includes torque demand, engine speed, cam mechanism position and solenoid current regulator signals.

5 Claims, 5 Drawing Sheets

CONTROLLED FUEL INJECTION RATE FOR OPTIMIZING DIESEL ENGINE OPERATION

TECHNICAL FIELD

This invention relates to the pulsed injection of fuel into the combustion chambers of internal combustion engines, and more particularly, to a new and improved system and method of controlling the fuel pumping event for optimizing engine operations over a wide range of speeds and loads with improved fuel burn accompanied by reduced engine noise and exhaust emissions.

BACKGROUND OF THE INVENTION

Prior to the present invention, various systems have been devised to improve the performance of internal combustion engines and more particularly diesel engines by controlling fuel intake and subsequent pumping of the fuel into the combustion chambers of the engines through their injectors.

Generally, prior systems and controls for controlling the injection event have featured the ending of the event by (1) gradually decaying injection pressure as the pumping plungers slow down going over the nose of the pumping ramp of an associated cam, or (2) by rapidly terminating injection pressure with sharp cut off by opening a fuel feed port mechanically or electrically. However, such controls produce high emissions when the engine runs at high speed and there is a gradual decay in injection pressure as in (1) above. Further, high emissions and also noise levels occur at low engine speeds including idle when there is a sharp cut off in injection pressure as in (2) above. Such prior systems offered either a sharp ending injection rate or a soft ending injection rate with the cam velocity profile chosen to be the best compromise profile for overall engine performance. To provide for improved injections, various constructions and methods have been devised which include electronically controlled injection. An example of such system is disclosed is U.S. Pat. No. 4,757,795, issued Jul. 19, 1988 to William Kelly, in which a solenoid valve is employed to meter quantities of fuel into the combustion chambers. However, to meet new and higher standards for emission, noise and economy, new and improved fuel injection control systems and injection methods are required. To this end, the present invention meets such requirements by straight forward controls and methods by which the rate of fuel injection and profiled of the fuel pulse waves can be varied to optimize engine performance for all engine speeds and loads.

SUMMARY OF THE PRESENT INVENTION

The present invention is in the general category of that disclosed in the identified prior art patent but is drawn to a new and improved system and method that improves the control of the rate of fuel injection into the combustion chambers of an engine. This invention precisely shapes and injects measured pulses of fuel tailored to varying engine operating conditions for optimizing engine operations through the entire range of speed and loads.

More particularly, the present invention advantageously controls the fuel delivery rate and varies the shape of fuel pulses by starting and ending the injection event at varying predetermined points on the pumping ramp of a cam associated with pumping plungers of the system. This invention pre-spills fuel while operating to selected points on the pumping ramp of the cam until signals from a controller initiate closure of the fuel spill valve to allow greater flexibility in the overall rate of injection, including the rate in the ending of the fueling event. An optimized cam profile enhances wave profiling by effective use of varying sections of the cam for fuel injection. To produce such different fuel rates, special controls are employed to determine the duration of injection needed to supply the appropriate amount of fuel at given engine speeds and loads. The different fuel rates available for each fuel pulse provides for pulse wave shaping so that the combustion is optimized for improving efficiency in fuel consumption, reducing particulate emissions, and reducing engine noise levels over the entire range of engine speeds and loads.

One feature, object and advantage of this invention is to provide a new and improved fuel injection system for internal combustion engines having a fuel pumping cam mechanism, portions of which are selectively employed to change the effective pumping profile to yield a wide range of fuel pulse shapes and injection rates for different engine speeds and loads.

Another feature, object and advantage of the present invention is to control and vary the shape of fuel pulse waves fed to the combustion chambers of an internal combustion engine by starting the point of injection at varying predetermined points on the pumping ramps of the cam and controlling the rate of injection at the end of the fueling event in accordance with cam profile data and fuel calibration of a programmed microprocessor used in a control system for improving engine fuel consumption efficiency, particulate emission reduction, and reduction of engine noise levels over a wide range of engine speeds and loads.

Another feature, object and advantage of this invention is to provide a new and improved method of shaping and controlling the pulse waves of fuel supplied to engine combustion chambers for optimizing engine operation.

These and other features, objects and advantages of the present invention will become more apparent from the following detailed description and drawing in which:

DETAILED DESCRIPTION OF THE DRAWINGS

Figure 1:
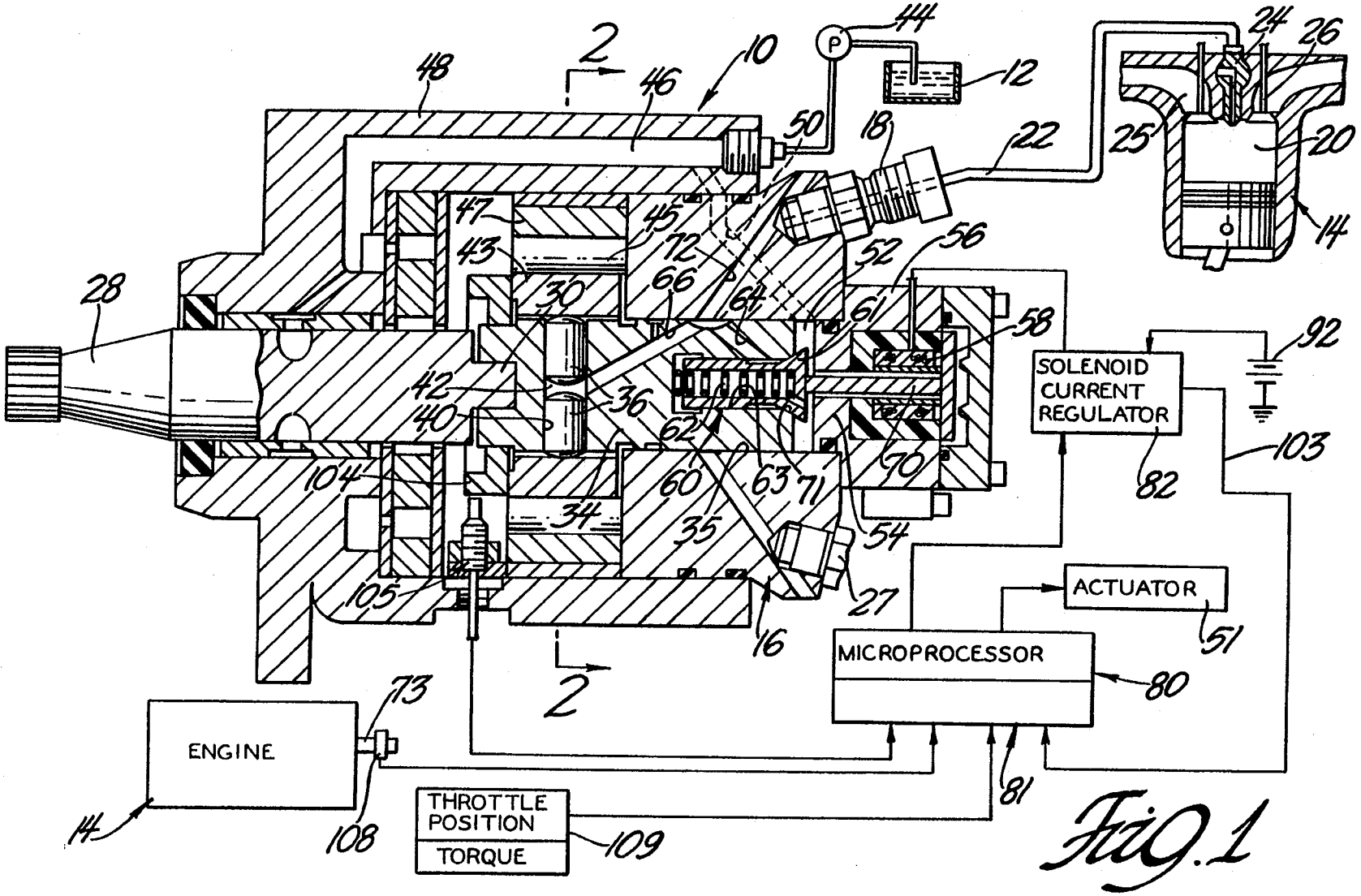
FIG. 1 is a diagrammatic sectional view of a fuel distributor pump and controls delivering fuel to an internal combustion engine.

The present invention can be employed with various fuel distribution systems, including the rotary distribution pump 10 of FIG. 1 for pumping and distributing pressure waves or pulses of liquid fuel supplied from a fuel tank 12 to the combustion chambers of an internal combustion engine 14. The pump 10 has a head assembly 16 with discharge fittings, such as 18, for feeding the fuel pulses to the engine combustion chambers, such as 20, through a high pressure fuel injector line 22 and fuel injector 24. The injector has a conventional spring loaded needle valve that is opened by the pressure of the pulses of fuel delivered by the pump at the appropriate time in the firing cycle. Air is drawn into combustion chamber through inlet valve 25, and after combustion, the gasses formed during ignition are expelled through open exhaust valve 26.

Other fuel discharge fittings, such as fitting 27 which is only partially shown, are arranged to feed fuel to other injectors and associated combustion chambers in the engine through similar injector lines and injectors not illustrated.

The distribution pump 10 has an elongated cylindrical drive shaft 28 adapted to be rotatably driven by an output of the engine 14. The inboard end of the drive shaft 28 has an axially extending polygonal drive key 30 that drivingly fits into a mating centralized socket formed in the longitudinal axis of a cylindrical rotor 34 that is rotatably mounted in a cylindrical bore 35 in the head assembly 16 of pump 10.

The rotor 34 has pumping plungers 36 mounted for reciprocating linear stroking movement in a bore 40 formed as a diameter in the rotor 34 which provides an expandable and contractible fuel receiving and pumping chamber 42 that is supplied with fuel by a transfer pump 44 that pumps fuel from the tank 12 through a fuel passage 46 in the housing 48 of the distributor pump 10.

Figure 2:
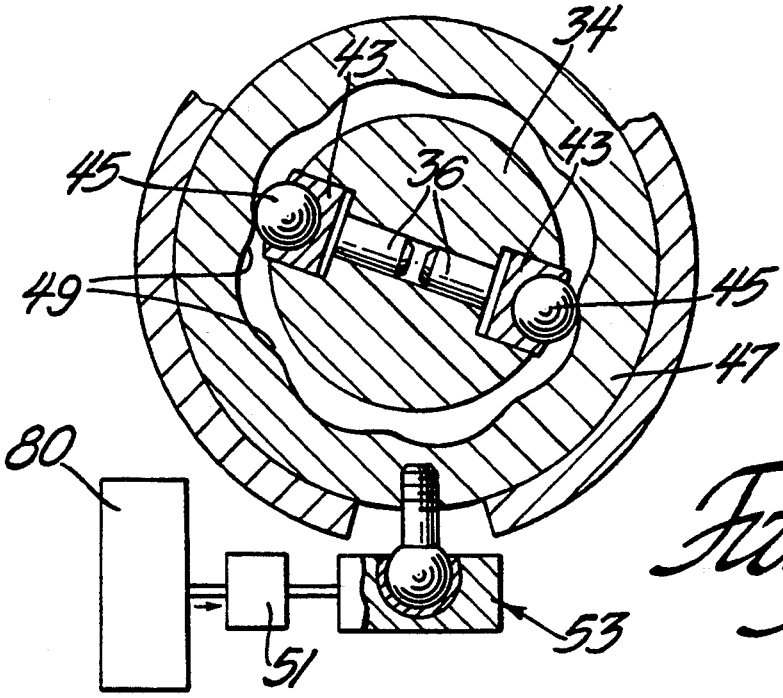
FIG. 2 is a cross sectional view taken generally along sight lines 2—2 of FIG. 1 diagrammatically illustrating the cam and plunger mechanism and further illustrating a cam displacement mechanism therefor.

The outer end of plungers 36 contact shoes 43 which have a U-shaped cross section that carry cylindrical rollers 45 that engage the annular cam member 47, which is best illustrated in FIG. 2. Cam member 47 has a plurality of lobed internal cams 49 defining a sinuous annular internal surface. Each cam 49 has an intake ramp and a variable rate pumping ramp as is well known in this art. The annular cam member 47 can be turned (advanced or retracted) in a cam support ring in housing 48 by operation of a stepper motor 51 drivingly connected to the cam by a suitable linkage here illustrated with a ball and socket connection 53.

The fuel passage 46 in the distribution pump housing 48 communicates by an inlet passage 50 in the head assembly of the distribution pump to an end chamber 52 formed between the end of the rotor 34 and the reduced diameter cylindrical neck 54 of a housing 56 of a solenoid 58 secured to the end of the head assembly 16.

A spill valve 60 having a conical head 61 and a cylindrical stem is mounted in an axial bore 63 formed in the outboard end of the rotor 34. The stem of this valve is hollow and houses a helical spring 62 that shifts the valve 60 to an open position when the solenoid is "off". When this occurs on an intake stroke, fuel can be supplied through passage 46, chamber 52, open valve 60 to the pumping chamber 42 through paired diagonal fuel feed passages 64, 66 formed in the rotor.

When the spill valve 60 is shifted to a closed position by the linear movement of the solenoid armature 70 in response to the solenoid energization, the conical head 61 of the spill valve is forced by the armature into sealing engagement with its conical seat 71 formed in the end of the rotor 34 so that passage 64 is sealed. Under these conditions, with spill valve closed, the plungers stroking inwardly by the lobed cam 47, pump high pressure waves or pulses of fuel through passage 66 and an aligned fuel injection passage, such as passage 72, as illustrated in FIG. 1.

Passage 72 feeds the high pressure fuel into fuel discharge fitting 18 so that the pressure wave of fuel is injected into the injector 24 effecting needle valve lift and then into combustion chamber 20. After the fuel is injected and the intake air is fully compressed by the piston at the top dead center (TDC), the fuel and air mixture ignites to stroke the piston to turn the crank shaft 73. Gases formed during ignition are expelled through the exhaust valve 26 on upward stroke of the piston to complete the cycle.

As the rotor rotates in the head assembly, the feed passages 66 will be sequentially aligned with other fuel injection passages leading to the different discharge fittings, and through these fittings the pressure waves will be sequentially fed into associated combustion chambers of the engine 14. As the rotor turns from alignment with each fuel injection passage, that passage is mechanically blocked.

To provide for improved tailoring of each injection event for improving engine firing, this invention controls the operation (energization and de-energization) of solenoid 58 through microprocessor 80. By energizing the solenoid 58 at different points or angles along the pumping ramp of the cam as determined by engine operating conditions, the start of injection is determined and detected by the microprocessor. The microprocessor knowing the cam angle for start of injection and the quantity of fuel to be injected calculates the angle at which fuel injection is to be terminated. The microprocessor accordingly de-energizes the solenoid after a predetermined angle is reached so that delivery of the desired fuel quantity is injected.

Figure 6:
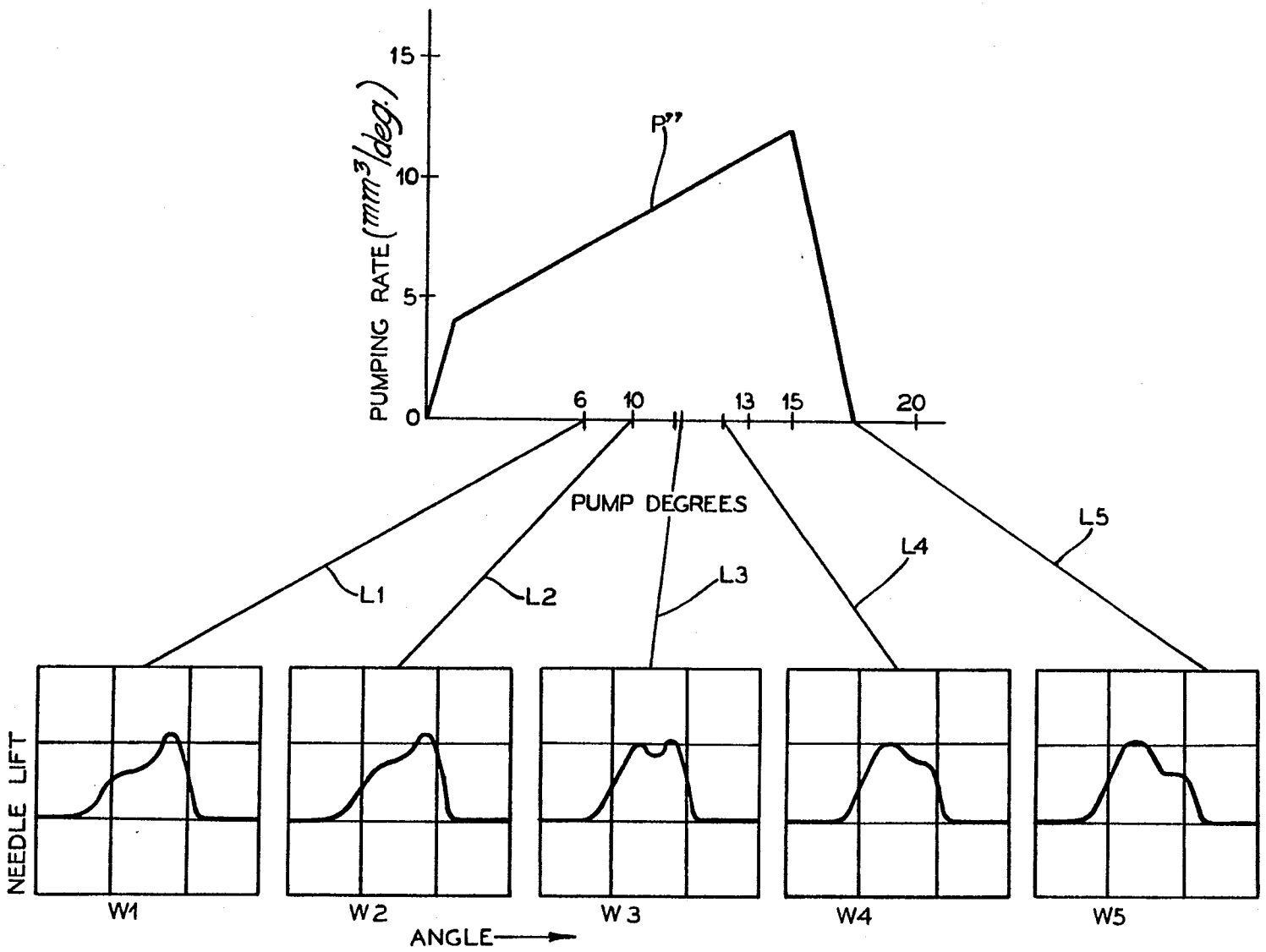
FIG. 6 is a diagram of the velocity representation of the profile of the cam of FIGS. 1–2 and corresponding profiles of fuel pressure waves obtained by using different portions of the cam for optimizing fuel injection.

On solenoid de-energization, the valve 60 is displaced by spring 62 to move head 61 of the valve element from its seat and the fuel is "spilled" into the end chamber 52, and thereby back into the fuel supply system. These controls shape the fuel pressure pulses or waves with varying rates in accordance with predetermined classic injection profiles, such as shown in FIG. 6 for examples, programmed into the software of the microprocessor for optimizing fuel burn in the combustion chambers of the engine.

With such pulse wave profiled in accordance with engine operating conditions, there is improved engine performance with sharply reduced noise level and particulate emissions over the range of engine loads and speeds including idle through high engine speeds and under varying load conditions. For example, at maximum load a first fuel wave shape or profile may be required for optimized performance at 1500 rpm while an entirely different wave shape or profile is needed at wide open throttle, 3400 rpm.

Figure 3:
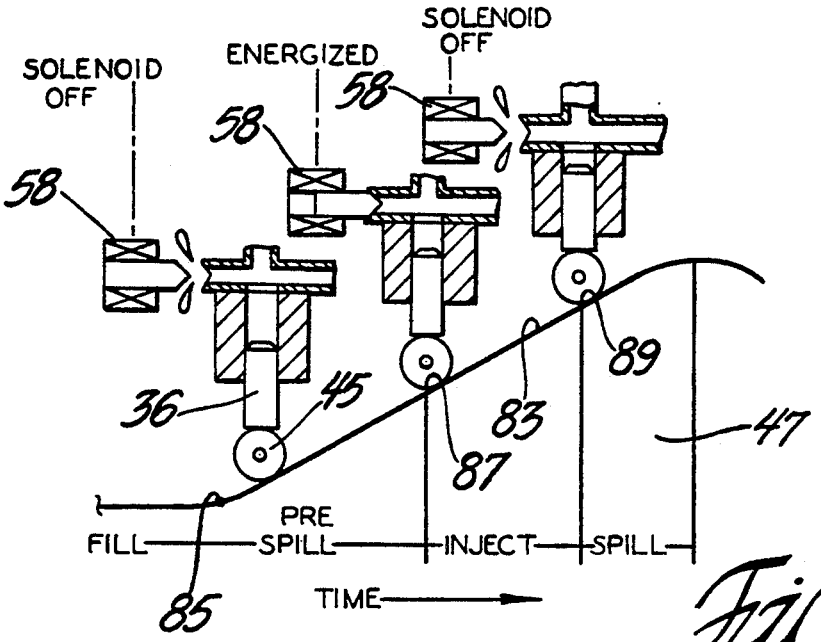
FIG. 3 is a diagram illustrating operation of a preferred embodiment of this invention featuring controlled prespilling of the fuel before the start of fuel injection.

FIG. 3 diagrammatically discloses the general operation of the pumping plunger 36 and solenoid 58 in controlling the "prespill" "injection" and "spill" operation of this invention as each of the variable rate pumping ramps 83 of the cams 49 of cam member 47 is traversed. At the beginning of the pumping ramp represented by point 85, the solenoid is in an "off" mode so that valve 60 is open for prespilling the fuel. In prespill, the turning rotor 34 and associated plungers operating on the cam pump fuel, but, because the spill valve 60 is open the fuel is prespilled back into the end chamber 52 and the fuel supply system. Prespill continues until at a predetermined cam angle the microprocessor determines the time, or angle, for the start of fuel injection for the upcoming cylinder by effecting energization of the solenoid 58.

This angle is illustrated at angle or point 87 on the variable rate pumping ramp in FIG. 3 and the spill valve is closed by the solenoid 58. With the spill valve closed prespill is terminated and the pumping plungers force the fuel through a discharge fitting 18 into a combustion chamber exemplified by chamber 20 of the engine to start the pumping of a shaped pressure wave or pulse of fuel. The microprocessor, active in determining the rate and the pulse shape, will calculate the position on the cam at which a predetermined quantity of fuel has been pumped and terminate the injection by de-energizing the solenoid. At point 89 on the cam, for example, fuel spill is initiated for pulse wave termination and shaping the pulse wave at the end of injection. This shaping is determined by the rate for termination which can be either sharp or gradual on a gradient therebetween depending on the engine operating conditions, the position of the cam and the variable rate pumping ramp of the cam selected for fuel injection.

Figure 4A:
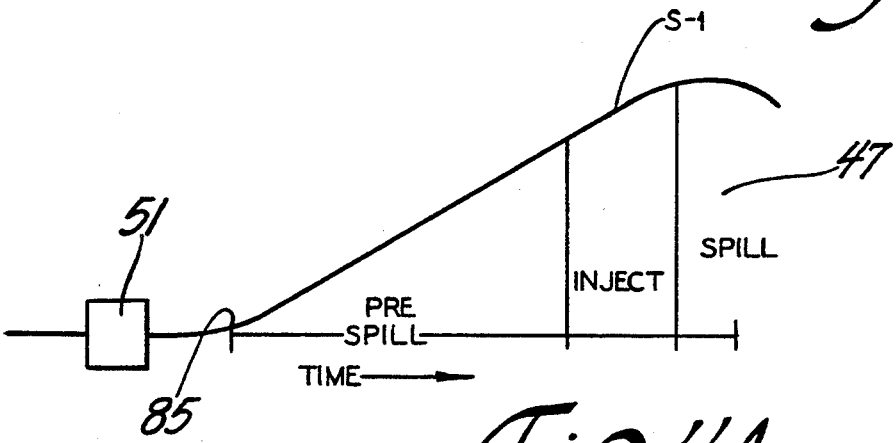
FIGS. 4A and 4B are diagrams illustrating movement of the cam for controlling the profile and timing of fuel pulses of this invention.

FIG. 4A illustrates the advance movement of the cam member 47 by the stepper motor 51 whose operation in turning the cam member in its support is coordinated by the microprocessor 80 with solenoid operation to optimize fuel delivery rate and pulse wave shaping. Cam member 47, and therefore cam 49, is advanced so that the engine is running on the upper segment S-1 of the cam profile. Under such pumping conditions the injection rate and pulse wave will gradually decay at the end of injection since the plungers are working on a segment or portion of pumping ramp 83 of the cam having a low slope. Accordingly, the injection is graduated for a slower and more controlled burn for idle and low engine speed operations. With such gradual burns the engine idle is smoother and noise and smoke levels are reduced as compared to profiles with a sharp end of injection.

Figure 4B:
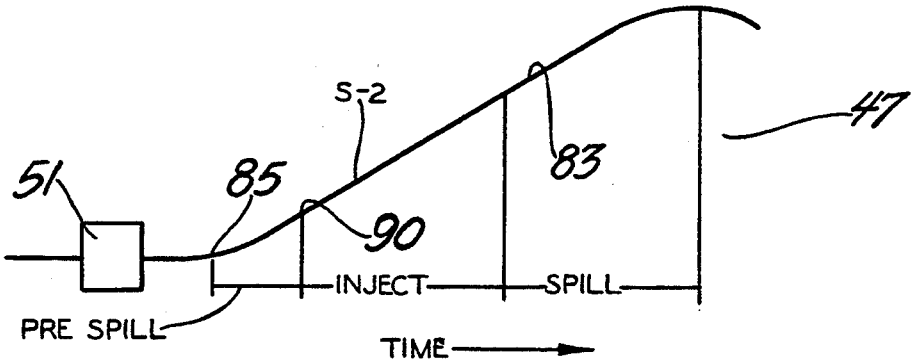

As engine speed increases to a higher speed, the stepper motor 51 turns the cam member 47 back to a retracted position, shown in FIG. 4B, so that the injection event occurs when the plungers are working on a steeper segment of the cam 49 identified by segment S-2. There, the injection event is started at the termination of prespill at point 90 of the pumping ramp of the cam. The pumping of fuel into the cylinder is started and continued until the microprocessor has determined that sufficient angle has been reached for the combustion chamber to receive a predetermined amount of fuel. For such operating conditions the fuel pulse wave is sharply terminated at a precise spill point or angle for maximizing engine operation at the higher speed and load conditions.

FIG. 5A through 5D diagrammatically illustrate one software method for the microprocessor to determine where to de-energize the solenoid for a desired quantity of fuel when starting at different cam angles. The cam profile is defined by fuel quantity versus angle. Starting angle "A" on the abscissae of FIG. 5A for beginning injection is found by knowing where the solenoid is closing on the pumping ramp of the cam profile. By finding the amount of fuel B, not used (since it has been prespilled by the delayed closure of the solenoid) and by adding the desired delivered fuel quantity Q to the value B, point C on the ordinate (fuel per cycle) is determined. By using the displacement curves, lower speed curve #3 for example, the corresponding angle on the cam, angle D, is determined.

When the plunger reaches this angle, the desired quantity Q of fuel has been injected so the microprocessor de-energizes the solenoid and in effect establishes point C. By subtracting angle A from angle D, the duration angle for injecting the desired fuel quantity Q is determined. At lower speeds some compensation may be needed to account for system dynamics due to leakage and plunger bounce. While this method is described in terms of angle, time or other duration concepts could be used.

The exemplary curves Nos. 1 through 3 represent engine speed in fuel delivery in $mm^3$/cycle for progressively decreasing engine speeds. For example, if the engine is operating on speed curve No. 1 and the microprocessor has determined that the start of injection is still at Angle A. The solenoid will be closed at point B′ on the ordinate with the quantity B′ representing prespill. Since a predetermined quantity Q of fuel is to be injected for all speeds, point C′ is established which is equal to B′ plus the desired fuel quantity for this operation. By determining the intersection of the desired fuel quantity C′ with curve No. 1, point D is again the angle on the cam where injection is terminated with de-energization of the solenoid by signal from the microprocessor. Accordingly, at different speeds or displacement the same duration of injection occurs when injection starts at Angle A.

Figure 5A:
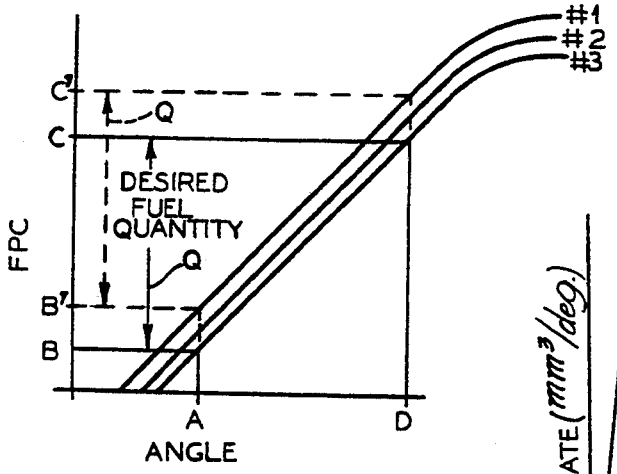
FIGS. 5A, 5B, 5C and 5D are plots illustrating the control intelligence programmed into the microprocessor.
Figure 5B:
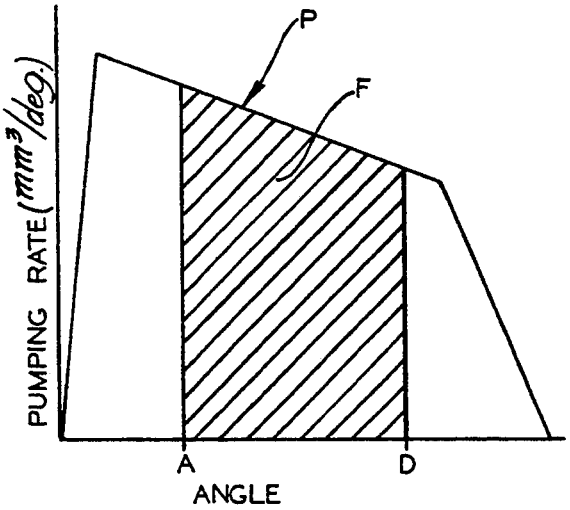

FIG. 5B correlates with FIG. 5A and illustrates the effective profile P of the cam with pumping starting at angle A and terminating at angle D with the hatched area F representing the quantity of fuel pressurized to inject into the combustion chamber. With this trapezoidal profile there is a high starting rate of fuel injection into the combustion chamber at angle A and a sharp termination at end of injection at angle D. These are optimized rates for intermediate and high speed operations.

Figure 5C:
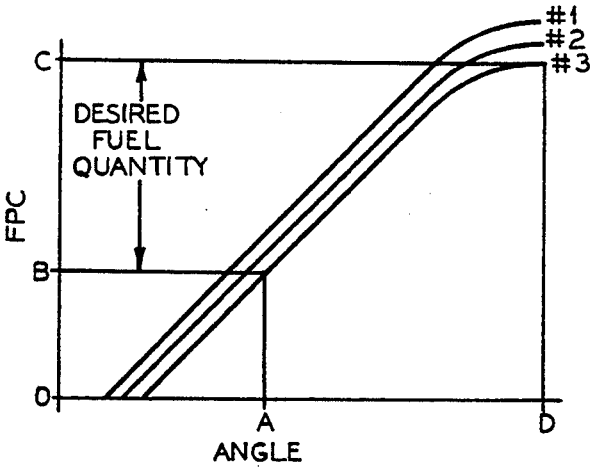
Figure 5D:
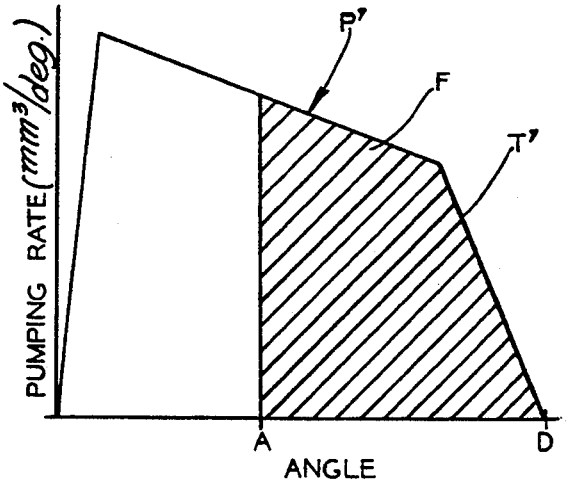

FIGS. 5C and 5D are respectively similar to FIGS. 5A and 5B and illustrate the fuel injection operation at higher points (i.e. lower slope) on the cam needed for optimized performance at lower engine speeds. Accordingly, the microprocessor effects solenoid closure at Angle A on the abscissae which corresponds to point B on the ordinate (fuel per cycle) with prespill represented by B. Since the same quantity of fuel is desired for this lower speed operation, fuel is again spilled after the desired quantity of fuel has been injected at point C. The intersection of this point with the speed curve No. 3 determines the cam angle D in FIG. 5C. In comparison with FIGS. 5A and 5B, the fuel spill for termination occurs at a higher point on the cam which has a reduced slope. The effective cam profile is shown by the curve P′ in FIG. 5D and illustrates the soft end of injection segment T′ of this cam profile P′ for effecting the desired shaping of the pulse wave for operation at idle or low speed operations for optimized engine performance.

The curves shown in plots W-1, W-2, W-3, W-4, W-5 of FIG. 6 comprise a sample of the variation of injection rates and wave forms that are available with a cam 49, whose velocity representation of profile is illustrated by curve P″ with the fuel pumping rate on the ordinate in $mm^3$/degree and degrees of pumping on the abscissa. As disclosed above, predetermined sections of the pumping ramp of the cam are used for the controlled injections with tailored fuel pulse waves for optimizing engine operations. The lines L-1 through L-5 correlate the degrees of the pump ramp of the cam profile with the pulse wave form curves W-1 through W-5 with injector needle lift being shown on the ordinate of these wave forms.

In plot W-1 the injector needle lift profile created by the fuel rate from the pump has a soft beginning of injection and a fast end of injection which provides an optimized shape for noise reduction at higher engine speeds. To achieve this fuel rate the solenoid is energized near the beginning of the cam pumping ramp. At 6° on the pumping ramp, the passageways are full charged to open the fuel injector. The software control determines that four additional pumping degrees are required for the solenoid to be energized to output a desired 20 $mm^3$ of fuel. Accordingly, at 10° on the pumping ramp, the solenoid is de-energized to effect spill and sharp termination of fuel injection.

In plot W-3 the injector needle lift profile created by the fuel rate from the pump has a fast beginning and end of injection which optimizes particulate reduction at higher speed and torque operation. To achieve this fuel rate the solenoid is energized at 6° angle and at 10° angle pumping degrees the passageways were fully charged to open the fuel injector. The software control determined that 2.8 additional pumping degrees are required for the solenoid to be energized to output the desired 20 $mm^3$ of fuel. Accordingly, at a pumping ramp of 12.8 degrees, the solenoid is de-energized for terminating the injection.

In plot W-5 the injection needle lift profile created by the fuel rate from the pump has a fast beginning and a soft end of injection which optimizes particulate reduction low noise levels and low emissions for low speed and low torque engine operation. To achieve this fuel rate, the solenoid was de-energized, controlled prespilling, until 11 pumping degrees has been traversed. At 13 pumping degrees, the passageways were full charged to open the fuel injector. By the method of this invention, it was determined that 4.5 additional pumping degrees are required for the solenoid to be energized to provide output the desired 20 $mm^3$ of fuel. Accordingly, at a 17.5 pumping ramp degrees the solenoid is de-energized.

To achieve the injection needle lift profiles shown by plots W-1, W-2, W-3, W-4 and W-5 at the correct timing in relation to the TDC of the piston, the cam position actuator 51 appropriately advances and retracts the cam member 47.

Figure 7:
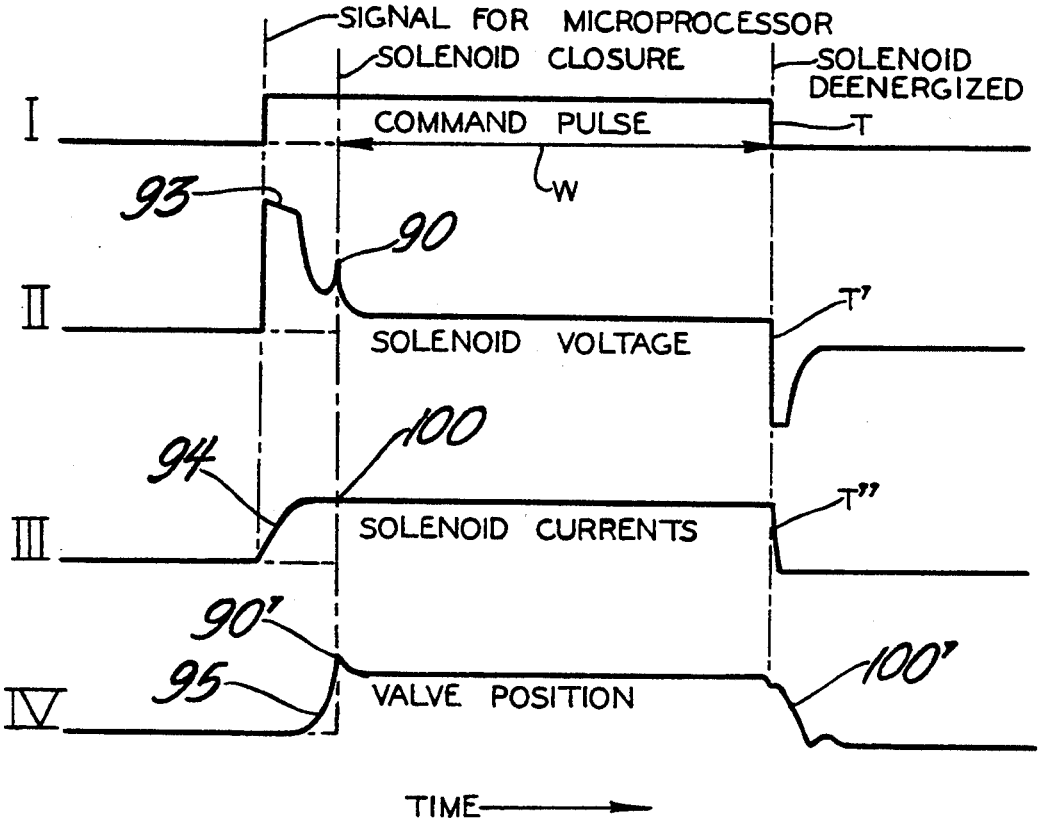
FIG. 7 is a family of curves illustrating injection control events of this invention.

In FIG. 7, curves I, II, III, IV illustrate injection controller events required to determined the precise start of injection of fuel into the combustion chambers. In curve I the microprocessor 80 sends a command pulse through the circuitry diagrammatically illustrated in FIG. 1 which energizes the solenoid 58. The current is regulated by regulator 82 so that the closing of the delivery valve is detected by the microprocessor reading perturbation point 90 in the voltage wave form as the wave form profile is fed back to the microprocessor. This point determines the exact fuel delivery valve closure event required to start fuel injection into the combustion chamber. With the solenoid closing, the spill valve 60 and the cam being in a positive velocity condition, the microprocessor determines the cam angle at which the onset of injection takes place.

When the microprocessor sends its command pulse out to initiate the fuel injection shown in curve I, the current regulator 82 applies the full voltage of battery 92 across the terminals of the solenoid as indicated at 93 in curve II. As the solenoid current ramps up, illustrated by segment 94 in solenoid current Curve III, the solenoid voltage peaks at 93 and then drops as it approaches the voltage level required to maintain a constant current. However, the inductance of the solenoid changes as a result of the movement of the armature and spill valve 60 as shown by the ramped portion 95 of the valve position curve IV. With this inductive change, the regulator has to apply more voltage which peaks at perturbation point 90 to hold the solenoid current constant at point 100, as indicated in curve III.

The microprocessor being fed with signals from the regulator through circuit 103 determines the angle or time to cut the voltage back, represented by point 90, to control the start of injection as defined by solenoid closure. Since the microprocessor knows where the solenoid is closed with respect to the plungers on the pumping ramp of the cam, it can readily determine where the solenoid has to be de-energized for spill to get the appropriate quantity of fuel delivered and to get the right rate of injection and fuel wave pulse profile for all engine speeds. Curve IV shows the valve position with closure at point 90′ and the valve opening by ramp segment 100′ after the voltage and current are dropped to zero as shown by segments T, T′ and T″ in curves I, II and III respectively.

As discussed above, the microprocessor responding to various inputs determines the portion of the pumping ramp of the cam to be used to select the appropriate wave for varying engine speed and load conditions. The microprocessor is fed with information from many sources, such as the solenoid voltage curve II of FIG. 7, as well as signals from sensor 105 secured in housing 48 which cooperates with rotatable toothed wheel 104 secured to rotor 34 to input the microprocessor with information, including information which tells the microprocessor where the pumping plungers are relative to the ramps of the cam so that it can send its command pulse to the solenoid. Other pickups such as 108 and 109 input the microprocessor with engine speed and torque demand signals.

While a preferred embodiment of the invention has been shown and described, other embodiments will now become apparent to those skilled in the art. Accordingly, this invention is not to be limited to that which is shown and described but by the following claims.

What is claimed is:

1. A method of fully shaping and and varying the full shapes of pressurized pulse waves of fuel directly injected into the combustion chambers of an internal combustion engine to optimize engine performance over a range of engine speeds and loads employing a fuel distribution pump having plunger means which operate across a fuel control cam with intake ramp means and variable rate pumping ramp means and having spill valve means controlled by a selectively energizable solenoid to effect the intake of fuel into the pump and to subsequently effect the pumping of predetermined quantities of said fuel as predetermined and fully shaped pulse waves into said combustion chambers whose shades are varied to match with different engine speeds and loads for optimizing engine performance comprising the steps of:

a. intaking fuel into said pump while said plunger means operates on the intake ramp means of said cam means, b. de-energizing the solenoid and prespilling the fuel as said plunger means leaves said intake ramp means and operates on the variable rate pumping ramp means of said cam means, c. energizing the solenoid when said plunger means reaches a predetermined angle on said variable rate pumping ramp means to terminate the prespilling of fuel so that said plunger means initiates the start of shaping of a shaped pulse wave of fuel pumped at a predetermined rate, d. de-energizing the solenoid when said plunger means reaches a subsequent predetermined angle on said variable rate pumping ramp means thereby spilling said fuel at a rate which shapes the end of said pulse wave resulting in a wave profile of a predetermined shape while effecting delivery of a predetermined quantity of fuel into said combustion chamber.

2. A method of fully shaping and injecting pressure waves of quantities of fuel into the combustion chambers of an internal combustion engine with varying wave profiles to match the operating conditions of the engine running at a varying range of speeds and loads for optimizing engine operation, with a fuel delivery pump having a solenoid operated spill valve in which fuel intake and fuel pumping plunger means operatively engage and traverse fuel intake ramp means and variable rate fuel pumping ramp means of fuel control cam means to effect the intake of fuel from a fuel supply into a fuel pumping chamber and to subsequently pump pressure waves of fuel from said fuel pumping chamber into said combustion chambers comprising the steps of:

a. initiating the intake of a quantity of fuel from the supply of fuel into said fuel pump chamber while said plunger means is operating on the intake ramp means of said cam means, b. after intaking said quantity of fuel into said fuel pump chamber, prespilling the fuel through said spill valve back to said fuel supply as said plunger means operates on said variable rate pumping ramp means of said cam means, c. determining the angular location on the variable rate fuel pumping ramp means at which said plunger means is to initiate the pumping of said pressure wave into a first of said combustion chambers, d. energizing the solenoid when said plunger means is at the determined angular location on said pumping ramp means so that said plunger means starts the pumping of a pressure wave of fuel into said first of said combustion chambers of said engine at a rate to shape the pressure wave at the start of injection, e. determining the angular location on the variable rate fuel pumping ramp means at which said plunger means is to complete the pumping of a wave of predetermined shape and quantity to match the operating condition of said engine for optimizing engine performance, f. subsequently de-energizing said solenoid when said plunger means reaches said last recited angular location on said pumping ramp means to complete the pumping of the desired quantity of fuel into said combustion chamber at a rate to shape the pressure wave at the end of injection by terminating said pulse wave through the spilling of said fuel back into said fuel supply to thereby optimize the combustion of fuel in accordance with the operating speed and load of said engine.

3. A method of controlling the fuel shape and quantity of pulse waves of fuel which mix with intake air to form the charges of fuel directly injected into the combustion chambers of an internal combustion engine for optimizing engine performance over a varying ranges of engine loads and speed in which the pulse waves are pumped by cooperating plunger means operating on a cam mechanism having fuel intake ramp means and variable rate fuel pumping ramp means with fuel intake and delivery being through a solenoid operated spill valve that is selectively opened during fuel intake and closed during fuel injection charge of said chambers in response to the timed de-energization and energization of said solenoid comprising the steps of:

a. relatively rotating said plunger means with respect to said ramp means of said cam to intake fuel while said plunger means engages said intake ramp means for subsequent pumping pulse waves of fuel by said cam mechanism and said plunger means into said combustion chambers while said plunger means engages predetermined segments of said pumping ramp means, b. maintaining said solenoid in a de-energized condition while said plunger means is on said pumping ramp means to prespill said fuel, c. energizing said solenoid after a selected angle has been reached on said pumping ramp to control the rate of fuel delivery at the start of injection of a pulse wave of fuel, d. determining a subsequent angle on said pumping ramp on said cam at which a desired quantity of fuel is injected into said combustion chamber and de-energizing said solenoid at said subsequent angle so that said spill valve is opened to terminate and further shape the pulse wave with a controlled end thereof.

4. The method of claim 3 above in which the pumping ramp of said cam defines a profile that provides a range of different pulse wave profiles that vary in accordance with the selected use of differing portions of said pumping ramp and further comprising the steps of:

a. regulating the voltage applied across said solenoid so as to maintain a steady state current flow through the windings of said solenoid, b. detecting the voltage of said solenoid at which the solenoid effects the closure of said spill valve for shaping the beginning of injection and thereby determining the angular position of said pumping plungers on said pumping ramp, c. subsequently effecting the de-energization of said solenoid as said pumping plungers reach a subsequent predetermined angular position on said ramp at which a desired wave profile and quantity of fuel is injected into said combustion chamber as a wave pulse with the end of the injection wave profiled with a sharp end at elevated engine speeds and a tapered end at a predetermined range of lower speeds from idle up to said predetermined range of lower speeds.

5. A fuel system including a distribution pump having a fuel supply passage and a pumping chamber for varying, fully shaping and injecting pressurized pulse waves of fuel from the pumping chamber into the combustion chambers of an internal combustion engine with rates and shapes which vary with the range of engine speeds and loads from idle to wide open throttle to improve fuel burn and reduce noise level and reduce exhaust of fuel burn particulates from said engine comprising:

a. a cam mechanism in said distribution pump having fuel intake ramp means and having fuel pumping ramp means with varying slopes so that fuel can be injected into said combustion chambers at varying rates and wave shapes, b. pumping plunger means in said distribution pump engaging said intake ramp means and relatively movable with respect thereto to effect the intake of fuel into said pumping chambers when operatively engaging at least a portion of said intake ramp means and to subsequently engage said pumping ramp means to effect the pumping of pulse waves of fuel from said pumping chamber into said fuel combustion chambers when operatively engaging varying sections of said pumping ramp means, c. fuel routing means for routing fuel from the supply passage to said pumping chamber, d. fuel delivery passage means for operatively connecting pumping chamber to said combustion chambers so that the fuel pumped from said pumping chamber by action of said pumping plunger means on said pumping ramp means to said combustion chambers, e. fuel prespill valve means movable between a first and closed position in which said pumping chamber is supplied with fuel from said supply passage by action of said plungers on said intake ramp means and a second and open position in which said fuel is prespilled from said chamber when said plungers are initially on said pumping ramp means, said fuel prespill valve means being subsequently moved back to said first position in which said pumping plungers initiate and supply a pressure wave of fuel from said pumping chamber through said fuel delivery passage to said chambers by action of said plungers of said pumping ramp means, f. a source of electrical energy, g. electrically energizable solenoid means operatively connected to said source of electrical energy for moving said prespill valve means to at least one of said positions, h. regulator means operatively connected to said solenoid for regulating the current supplied to said solenoid means and to provide a signal indicating the angular position of said pumping plungers on said pumping ramp means when said wave means is closed and said plungers begin to pump and profile the pulse wave of fuel at the start of fuel injection into at least one of said chambers, and i. control means operative to receive output signals from said engine and from said regulator means for further controlling operation of said solenoid when said pumping plunger means reaches an angle on said pumping ramp for completing the delivery of a desired quantity of fuel to said last mentioned combustion chamber by moving said valve means to said open position to spill fuel being pumped from said pumping chamber back to said fuel supply passage to thereby terminate the injection of fuel into said last mentioned combustion chamber and to profile said pulse wave of fuel to match the speed and load operations of said engine for optimizing engine performance.

* * * * *